US007207875B2

(12) United States Patent
Melvin et al.

(10) Patent No.: US 7,207,875 B2
(45) Date of Patent: Apr. 24, 2007

(54) SANDING FRAME AND STAND FOR A BELT SANDER

(75) Inventors: Jason R. Melvin, Baltimore, MD (US); Michael J. Walstrum, Columbia, MD (US); Carl F. Merhar, III, Baltimore, MD (US); Gregory A. Rice, Aberdeen, MD (US); Stuart J. Wright, Timonium, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/684,870

(22) Filed: Oct. 14, 2003

(65) Prior Publication Data

US 2005/0079810 A1 Apr. 14, 2005

(51) Int. Cl.
*B24B 41/00* (2006.01)

(52) U.S. Cl. ..... 451/360; 451/355

(58) Field of Classification Search ..... 451/340, 451/342–345, 355–359, 360, 361, 411, 424, 451/460, 420, 404, 454, 363
See application file for complete search history.

(56) References Cited

U.S. PATENT DOCUMENTS

| | | | | |
|---|---|---|---|---|
| 814,787 | A | 3/1906 | Lehn-beuter | |
| 1,841,787 | A | 1/1932 | Carter | |
| 2,538,044 | A | 1/1951 | Ruehle | |
| 3,431,686 | A | 3/1969 | Bergler | |
| 3,664,614 | A | 5/1972 | Baechle | |
| 3,828,484 | A | 8/1974 | Baechle | |
| 4,085,552 | A * | 4/1978 | Horine et al. | 451/340 |
| 4,114,665 | A * | 9/1978 | Decker | 144/286.1 |
| 4,265,283 | A | 5/1981 | Nash et al. | |
| 5,092,379 | A | 3/1992 | Stallings | |
| 5,421,126 | A | 6/1995 | Strege | |
| 6,854,701 | B2 * | 2/2005 | Brockmann | 248/671 |

FOREIGN PATENT DOCUMENTS

| | | |
|---|---|---|
| DE | 1 964 108 | 7/1967 |
| DE | 12 77 068.2 | 9/1968 |
| DE | 69 46 309 | 5/1970 |
| DE | 7935820 U | 4/1980 |
| DE | 42 11 738 | 10/1993 |
| EP | 0 027 219 | 4/1981 |
| EP | 0 138 112 | 4/1985 |
| GB | 1137638 | 12/1968 |

* cited by examiner

*Primary Examiner*—Dung Van Nguyen
(74) *Attorney, Agent, or Firm*—Michael P. Leary; Charles E. Yocum; Adan Ayala

(57) ABSTRACT

A frame for a portable power sander, the frame convertible into a stand for supporting the power sander in a stationary orientation wherein the abrasive belt is accessible, said frame comprising: a base; a leg connectable to the base, and a fence assembly connectable to the base.

38 Claims, 13 Drawing Sheets

SANDING FRAME AND STAND FOR A BELT SANDER

FIELD OF THE INVENTION

The present invention generally relates to electric powered portable sanders. More particularly it relates to an accessory for a portable sander that is convertible between a sander frame and a sander stand. As a frame, it supports or stabilises a portable belt sander as the user moves the sander over a wooden workpiece. As a stand, it supports the sander in an orientation wherein the sander's abrasive belt is exposed so that the user may manipulate a workpiece against the moving abrasive belt.

BACKGROUND OF THE INVENTION

A belt sander may be employed with either a sanding frame/shoe or an inversion stand.

Sanding frames are generally well known. Sander frames are used to expand the footprint or base of the sander on the workpiece below. When a belt sander is mounted in such a frame, the sander is stabilised for movement over the surface of the workpiece. If the user applies uneven or unbalanced levels of force to the sander's handle(s) then the frame/shoe will prevent the sander from tipping and/or gouging the work piece surface. Additionally, many sanding frames contain means for adjusting the depth-of-cut of the sander mounted within the rigid frame. With such a mechanism the user can adjust the amount of wood removed by the sander as it is passed over the workpiece.

Sander stands are also generally known. A so called "inversion stand" is an accessory that provides a fixed frame/base for holding the belt sander in an orientation on its side or inverted so that the abrasive belt is exposed for access by the user. Thus supported, the portable sander becomes a bench tool and the user can pass a piece of wood over the moving belt, or press and manipulate a workpiece against the moving belt. Inversion stands sometimes are provided with a table or fence to support and/or align the workpiece while it is slid over the sander belt.

Sander stands and frames are provided as two different accessories. They add to the bulk and weight of equipment the tradesman must transport to the work site. The stand, in particular, is intended for stationary use and current models are not very portable.

SUMMARY OF THE INVENTION

It is proposed to provide an accessory sanding frame that can be converted into an inversion frame by the addition of legs, which can be attached to the frame so as to support the sander in one of multiple possible orientations.

An advantage of such an adaptable accessory is that the sander frame performs double duty by serving as the mounting point for the sander in both the mobile frame role and fixed stand role. Savings are achieved in cost, weight, and storage volume.

A further advantage of the subject invention is that's since the sanding frame has a depth of cut adjustment, that capability will also be present in the fixed stand.

A still further advantage of the subject frame/stand is the provision of a particularly economical and easy to manufacture hinge structure for pivoting adjustment of the sander within the frame, and thus of the sanders depth of cut. Said hinges comprising an open recess in the frame, a bearing element of simple geometry and defining a cylindrical bore, and a retainer piece for holding the bearing in the recess.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention.

BRIEF DESCRIPTION OF THE DRAWINGS

A sander according to the present invention will now be described by way of example, with reference to the accompanying drawings in which.

DETAILED DESCRIPTION OF THE PREFERRED EMBODIMENT

Figure 1:
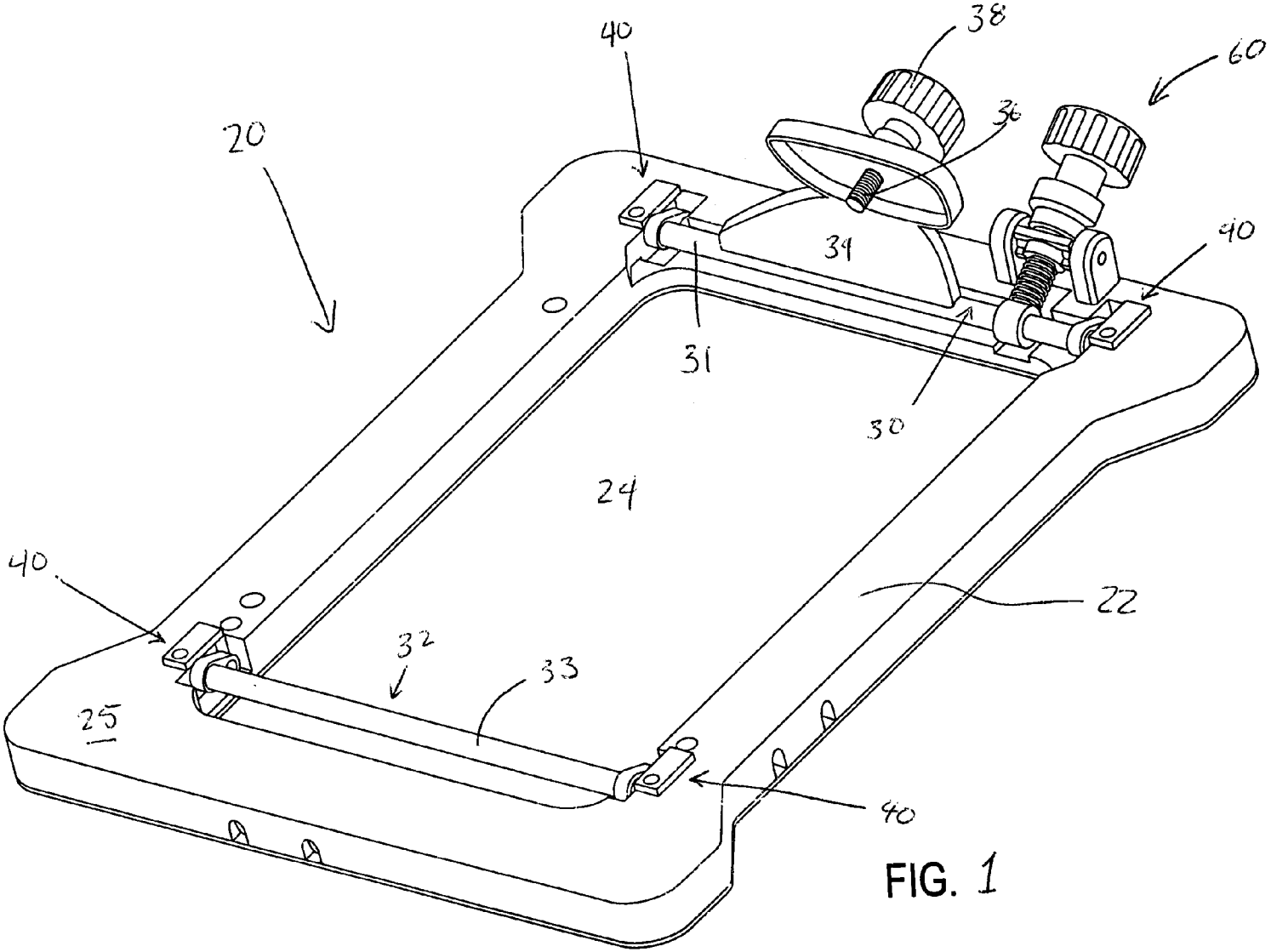
FIG. 1 is a perspective view of a belt sander frame according to the present invention.
Figure 2:
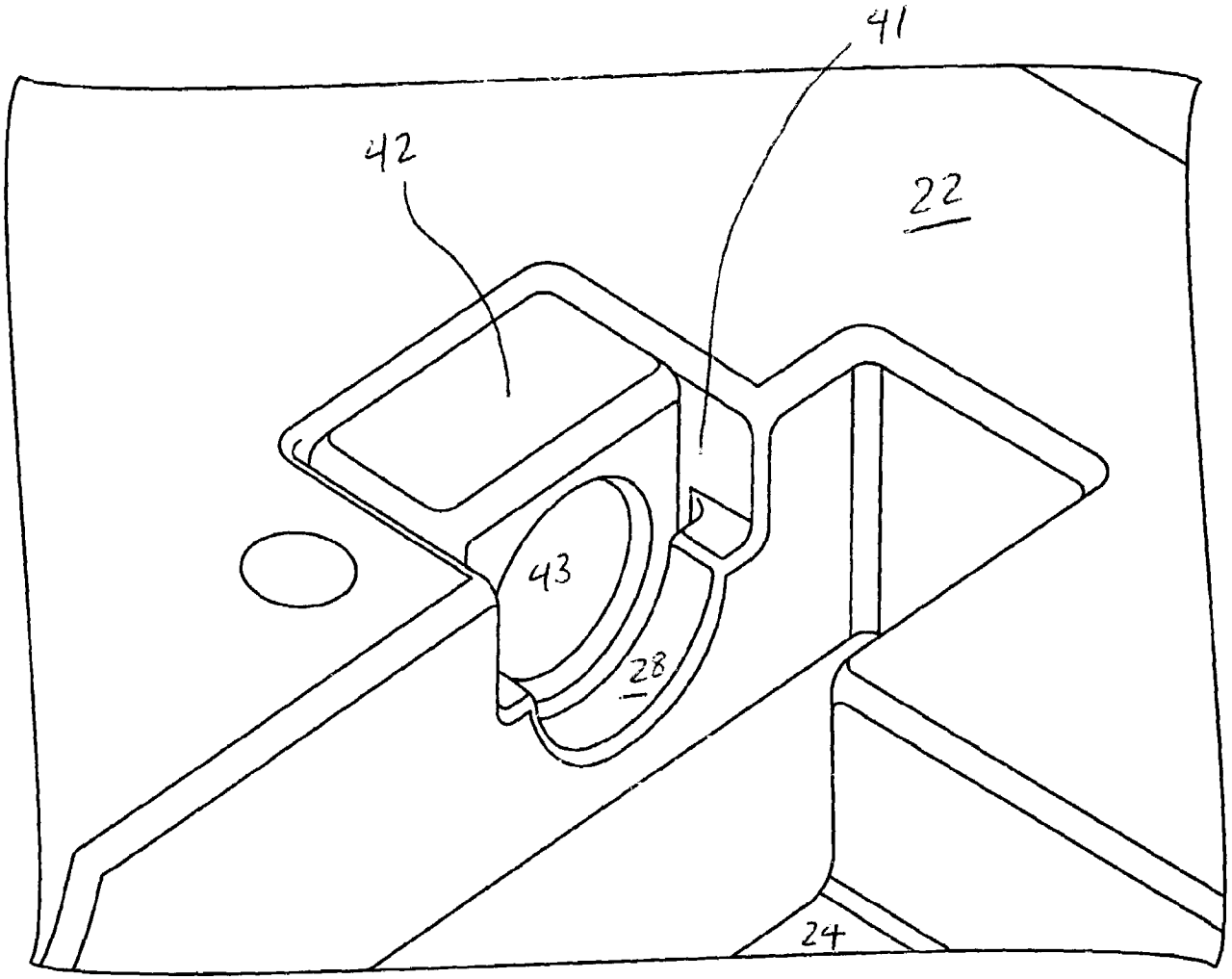
FIG. 2 is a close up perspective view of elements of the hinge structure of the frame of FIG. 1.
Figure 3:
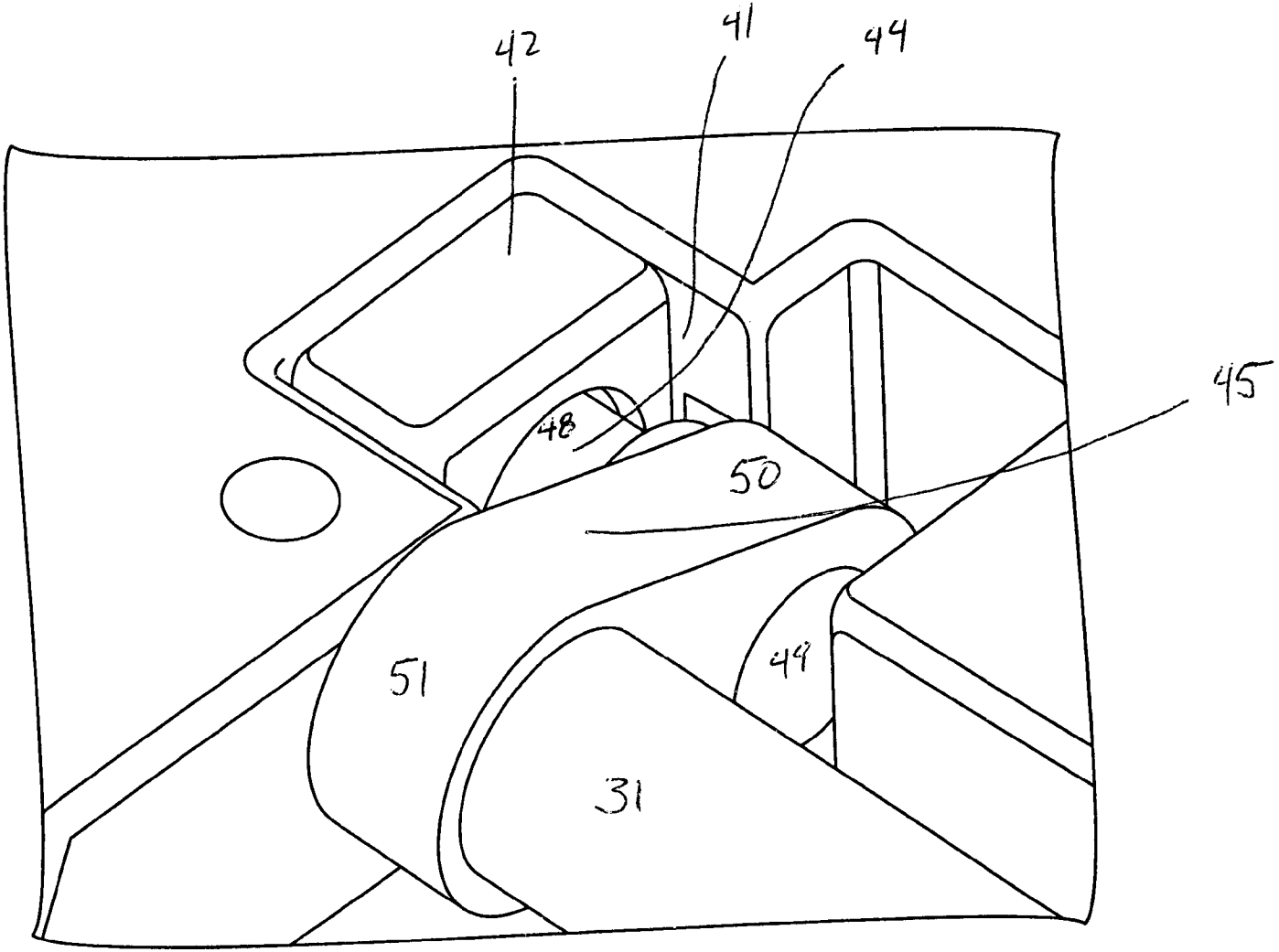
FIG. 3 is a perspective view of the hinge structure of FIG. 2 including additional elements.
Figure 4:
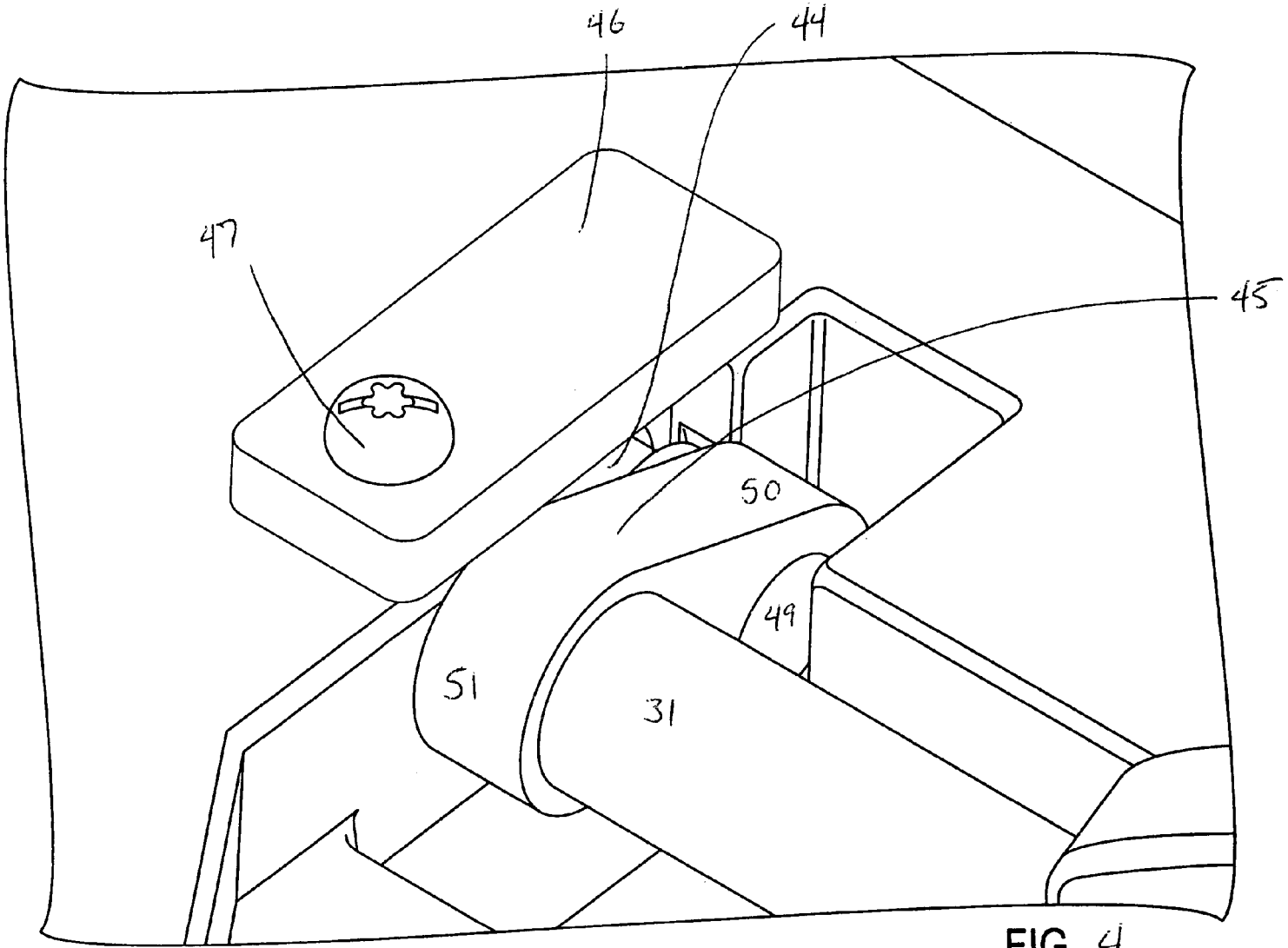
FIG. 4 is a perspective view of the hinge structure of FIG. 3 including still additional elements.
Figure 5:
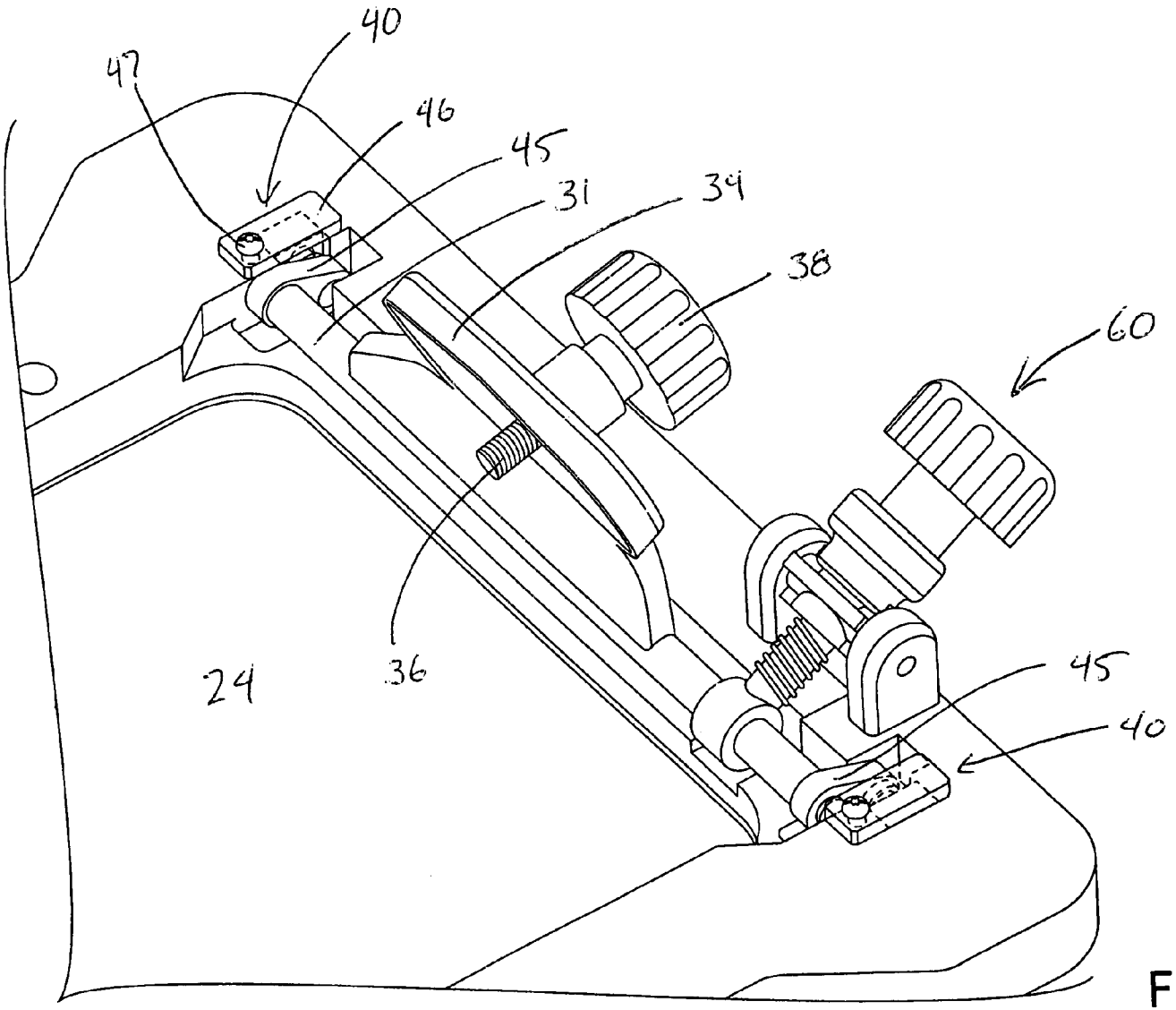
FIG. 5 is a perspective view of a portion of the frame of FIG. 1.

With reference to the attached FIG. 1, sander frame 20 consists of a base 22 defining an opening 24. In the preferred embodiment shown both base 22 and opening 24 are substantially rectangular. Base 22 has a first lower surface 23 and a second upper surface 25. First lower surface 23 is preferably finished or coated to move smoothly over the surface of a wooden workpiece.

A forward rod assembly 30 and a rearward rod assembly 32 are pivotally connected to the base 22 across opening 24 and proximate to their respective ends of the base. Forward rod assembly 30 is comprised of forward rod 31 and two hinge assemblies 40, and rear rod assembly 32 is comprised of rear rod 33 and two more hinge assemblies 40.

Connected to and pivoting with forward rod 31 is a mounting plate 34. Rotateably mounted within mounting plate 34 is threaded screw 36, which is turned by knob 38.

A depth-of-cut adjustment mechanism 60 is mounted to frame 22 and connected to forward rod 31 for pivoting the forward rod assembly 30. Adjustment of depth of cut mechanism 60 causes forward rod 31 to pivot upward and forward and out of the plane of the base 22, or rearward and downward into the plane of the base 22.

With reference to FIGS. 2–5, a particularly easy to manufacture and thus economical structure for hinge assemblies 40 will now be described. Near the corners of opening 24, recesses 41 are defined by the base 22. For ease of manufacturing, the recesses 41 are open toward the upper face 25 of frame base 22. Furthermore, each recess 41 is of relatively simple geometry. Preferably, it may be a simple rectangle or a semicylindrical shape or a combination thereof.

In the recess 41 is located a bearing 42. Bearing 42 may also be of a simple external geometry selected to conform to the recess 41. Bearing 42 defines a bore 43. Rotatably mounted in bore 43 is the first or outer end 48 of pivot pin 44. The second or inner end 49 of pivot pin 44 is connected to a first end 50 of pivot arm 45. The second end 51 of each pivot arm 45 is connected to either rod 31 or 33.

Bearing element 42 is captured in recess 41 by a retainer. In the preferred embodiment shown, retainer plate 46 covers the top of recess 41 and is secured to the base 22 by a machine screw 47. On the face of recess 41 towards the opening 24, a lip 28 of the base 22 also serves to retain the bearing element 42.

Figure 6:
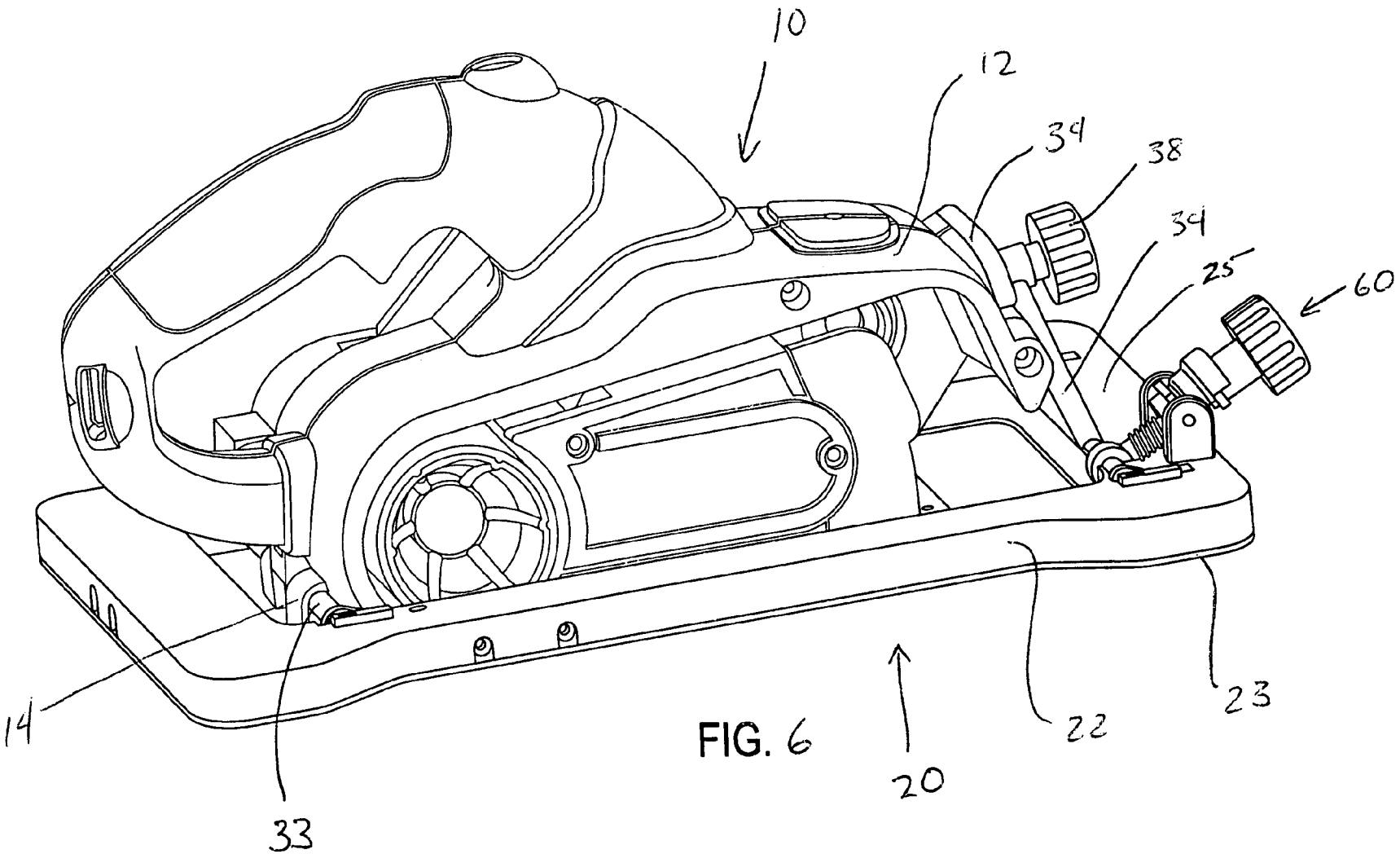
FIG. 6 is a right side perspective view of a belt sander mounted in the frame of FIG. 1.
Figure 7:
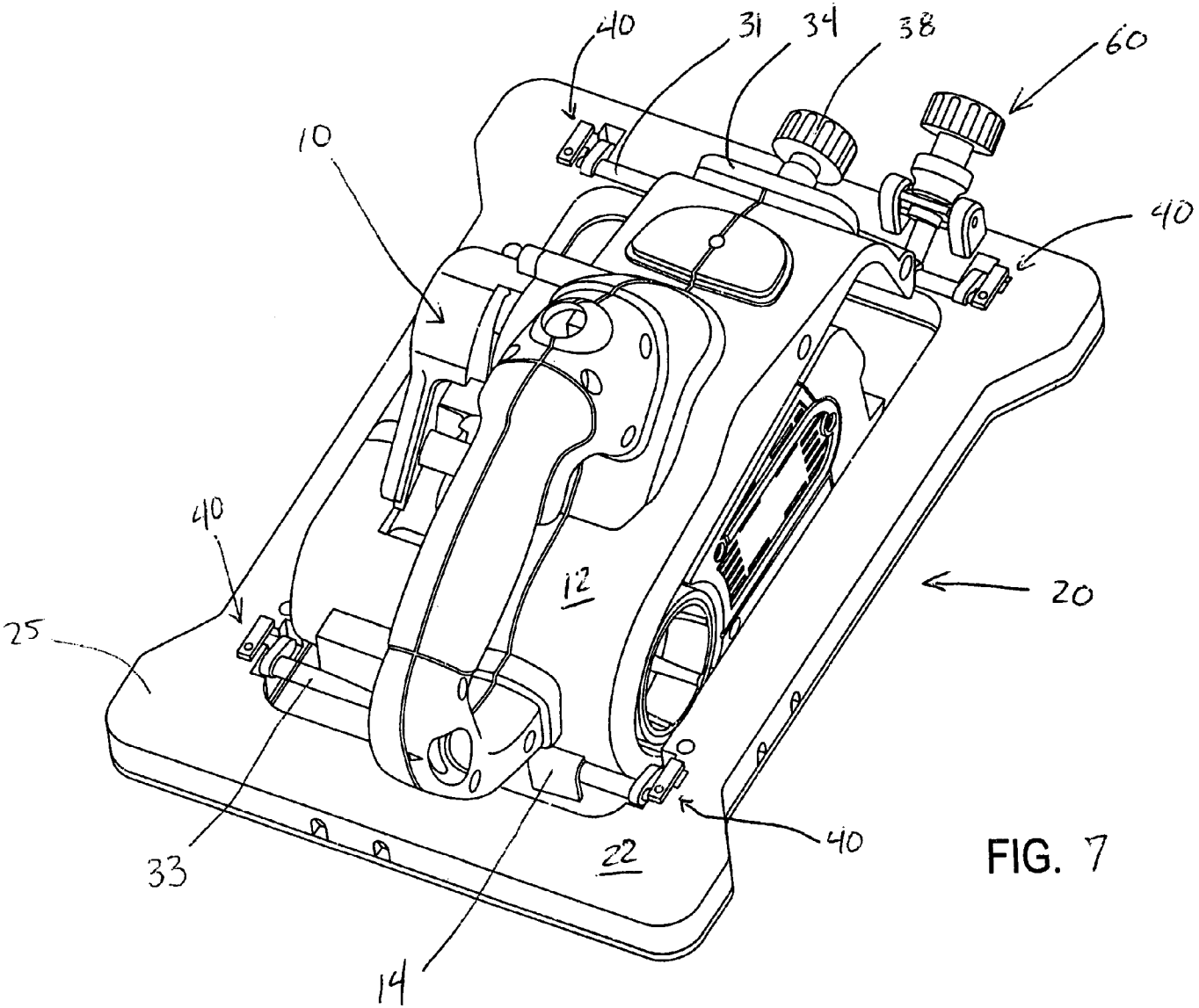
FIG. 7 is an alternative perspective view of the belt sander and frame of FIG. 6.
Figure 8:
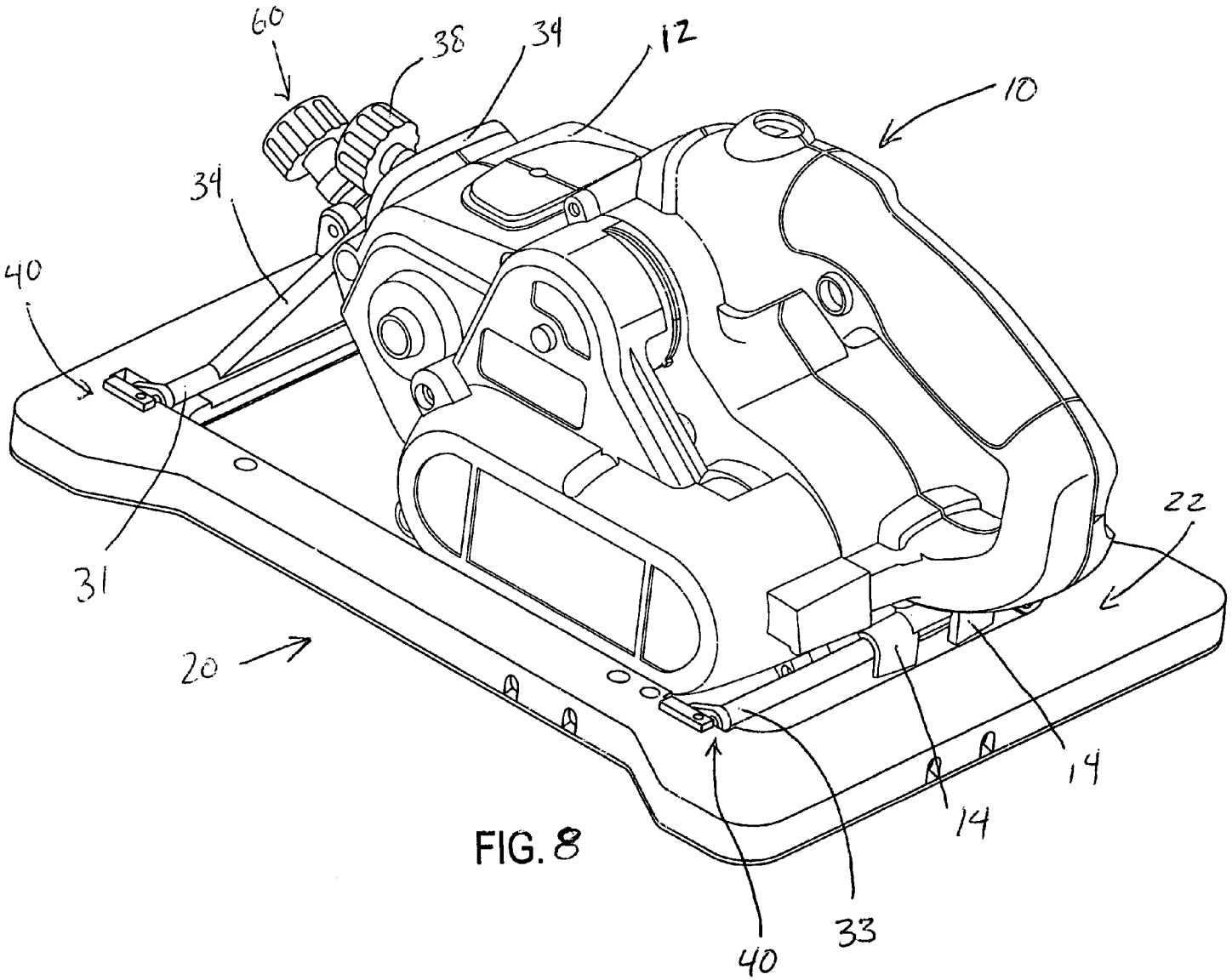
FIG. 8 is a left side perspective view of the belt sander and frame of FIG. 6.

Now with reference to FIGS. 6–8, the sander 10 (some structural elements of the sander are omitted for clarity and an improved view of the subject frame/stand) is shown mounted in frame 20. Sander 10 is connected to the pivotable rods 31 and 33 so that the sander can be raised or lowered relative to the base 22 for adjustment of the depth-of-cut. At its rear end, the sander housing 12 has clips 14 that clasp the rear pivot rod 33. At the front end of the sander housing 12, a hole 16 (not shown, but the same hole used to mount the auxiliary handle in its forward optional position) receives threaded screw 36. Knob 38 is used to tighten screw 36 and pull housing 12 against mounting plate 34.

Figure 9:
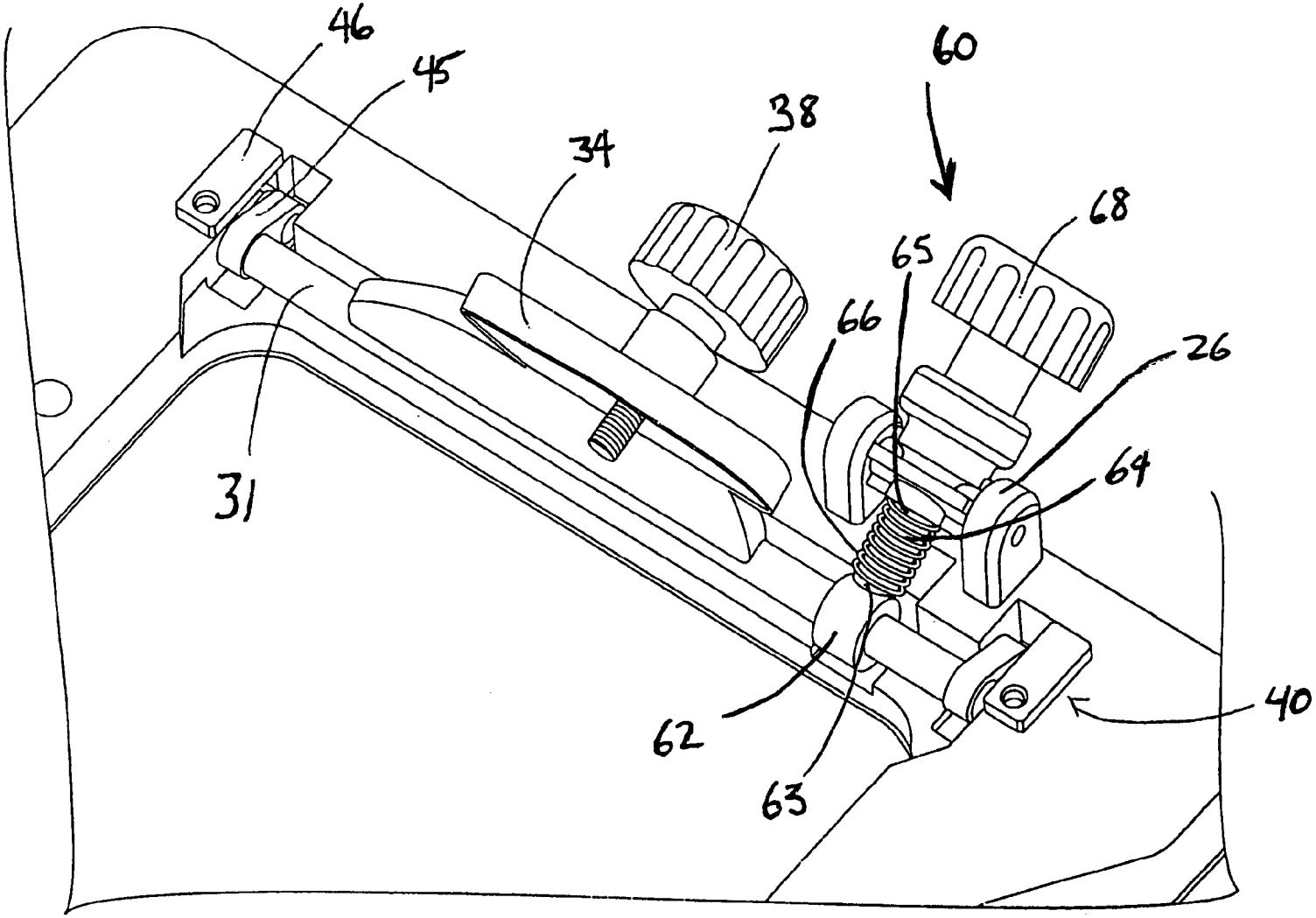
FIG. 9 is a close up perspective view of the depth-of-cut mechanism of the sander frame of FIG. 1.
Figure 10:
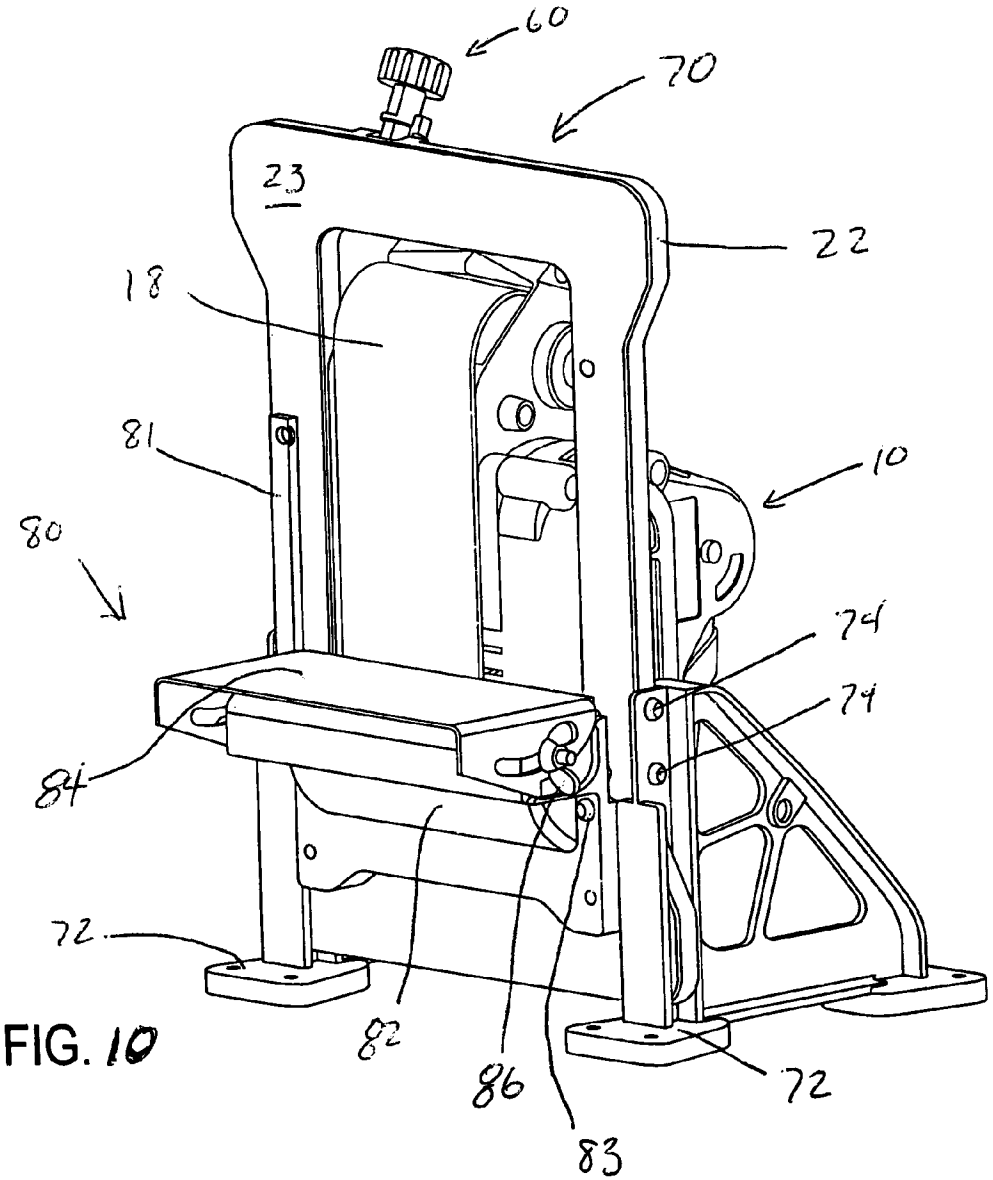
FIG. 10 is a underside perspective view of a belt sander mounted in the frame of FIG. 1 when converted into an inversion stand in the vertical orientation.
Figure 11:
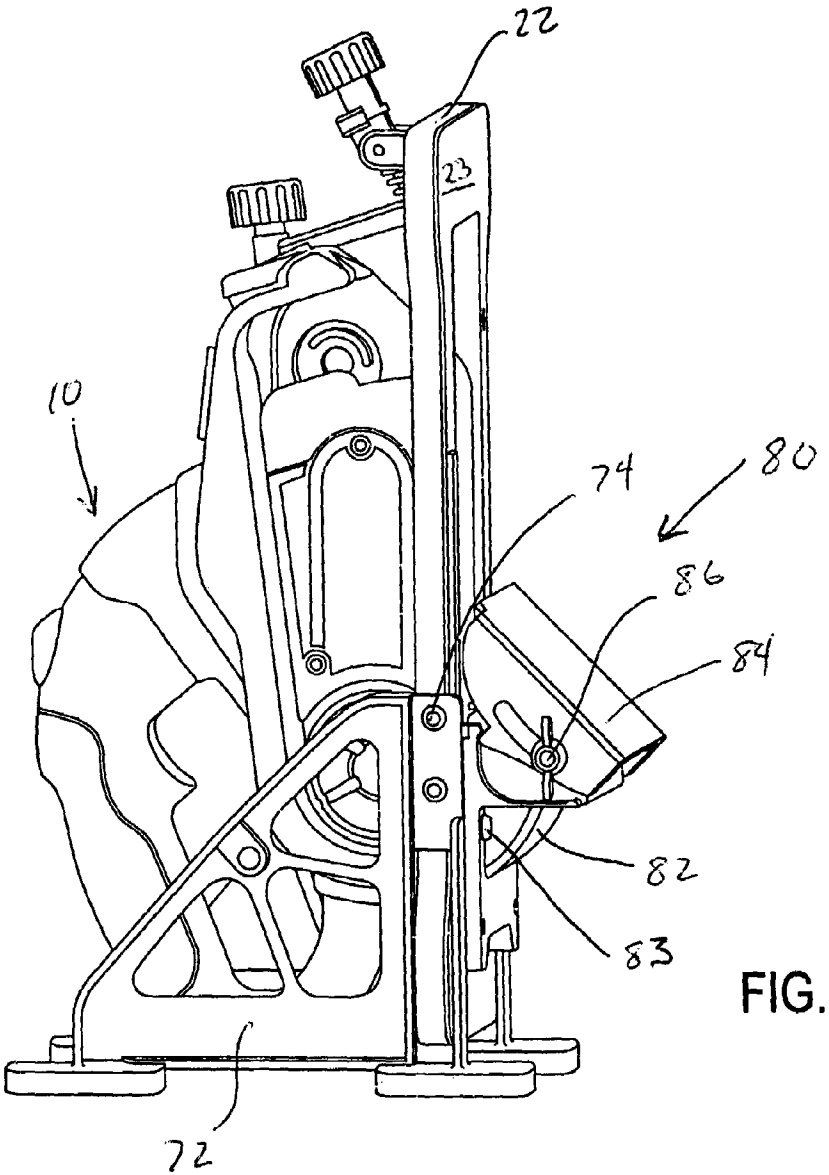
FIG. 11 is a side perspective view of the belt sander mounted in the inversion stand of FIG. 10.

With particular reference to FIG. 9, the depth of cut adjustment mechanism 60 will now be described. Mounted to frame base 22 is a yoke assembly 26. Yoke 26 defines a bore 27 (not shown). Front rod 31 passes through a collar 62. A threaded rod 64 having a first end 63 and a second end 65 is attached to the collar 62 at the first end 63. Threaded rod 64 extends through the bore 27 of yoke 26 and is threadably engaged by a knob 68 at the second end 65. A biasing spring 66 is mounted co-axially around the threaded rod 64 between collar 62 and yoke 26. Spring 66 acts to push the collar 62 and thus rod 31 downward into the lowered position. A user can turn knob 68 to pull the collar 62 and thus the forward rod 31 upward into a raised position, against the force of spring 66.

With the sander 10 connected between the forward rod 31 and the rear rod 33 (as described above), movement of the forward rod 31 is transmitted to the rear rod 33 and produces an identical pivoting movement. Thus, as the rods 31 and 33 pivot, the sander 10 moves in a arcuate path that raises or lowers the sander within the opening 24 while maintaining the sander's abrasive surface 18 planar parallel with the frame base 22, and thus to the workpiece.

With reference now to FIGS. 10–13, the sander frame can be converted into an inversion stand 70 by the addition of two legs 72 and a fence assembly 80. The legs 72 are secured to the base 22 by screws 74. Legs 72 may be connected to base 22 to achieve either a vertical orientation as in FIG. 10 or a horizontal orientation as in FIG. 12, wherein base 22 is substantially perpendicular to the ground. Alternatively, legs could be used to support the base 22 in an inverted orientation substantially planar parallel relation to the ground, and wherein first/lower surface 23 and the abrasive belt face upward.

Fence assembly 80 can be secured to base 22 by screws 83 in either of two positions complementary to the chosen orientation of the sander. Fence assembly 80 comprises a fixed element 82 and an angularly adjustable table 84, which may secured with nut 86 at the desired angle relative to the plane of the base 22.

Figure 12:
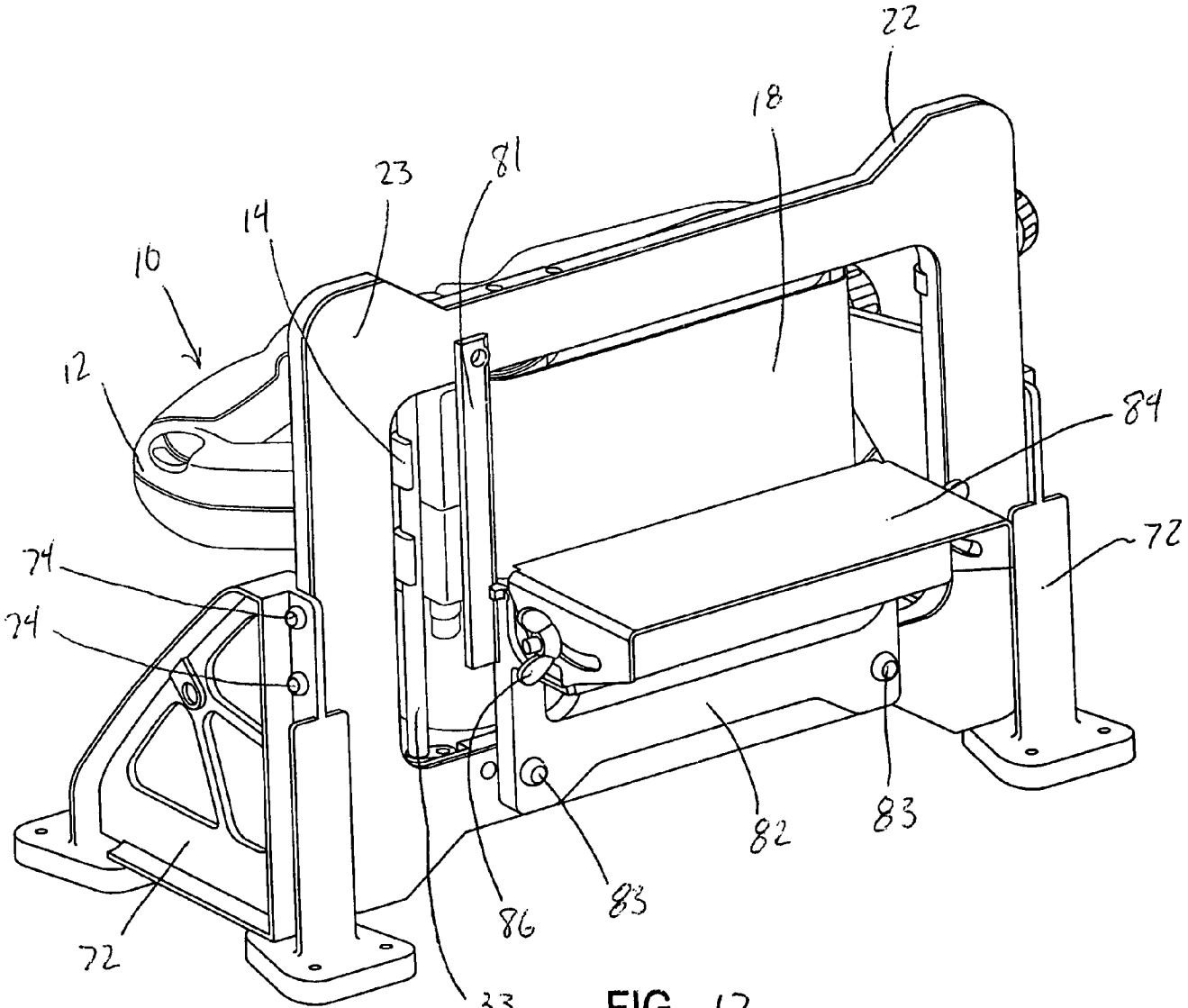
FIG. 12 is a underside perspective view of a belt sander mounted in the frame of FIG. 1 when converted into an inversion stand in the horizontal orientation.
Figure 13:
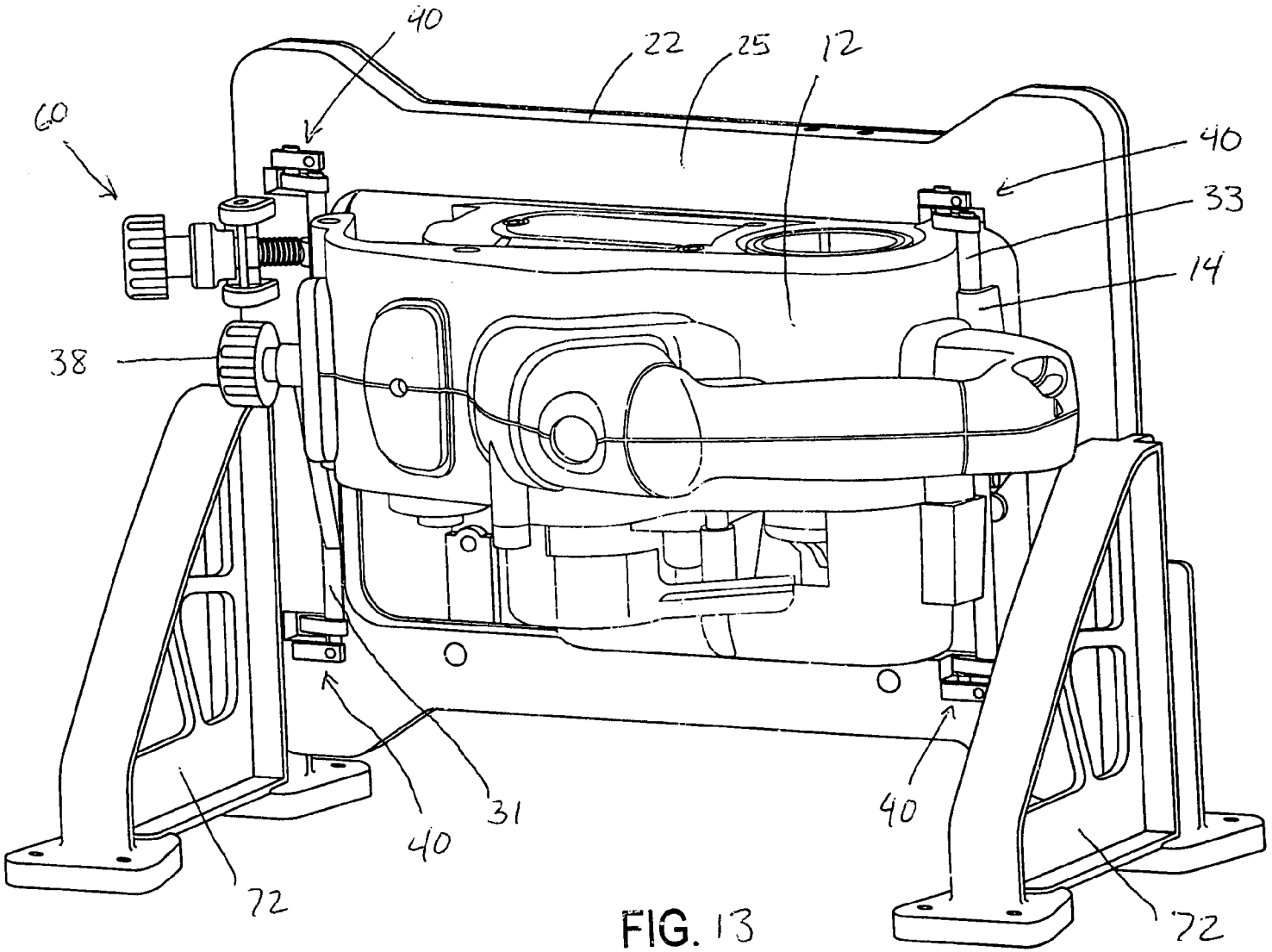
FIG. 13 is a top perspective view of the belt sander mounted in the horizontal inversion stand of FIG. 12.

Fence assembly 80 also includes a guard piece 81. As seen in FIG. 12, when the sander 10 is in the horizontal orientation, guard 81 is located adjacent to the abrasive belt and covers the gap between the rear of roller/belt 18 and the sander housing 12 in order to prevent a small/thin workpiece from being dragged into that gap by the movement of the belt 18. In the vertical orientation, the table 86 is directly in the path of the belt 18 and a separate guard is not required.

The above-described depth of cut adjustment of the sander 10 in the sander frame 20 permits the user to move the sander belt 18 towards and away from the table 84. This is particularly advantageous since the pivoting movement of the table 84 can open up a gap between the belt 18 and the table, and a small/thin work piece could be dragged into that gap by the movement of the belt.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

The invention claimed is:

1. A sanding accessory for supporting a portable powered sander with a movable abrasive surface, the accessory comprising:

a sanding frame adaptable for supporting the sander during movement of the sander over a workpiece, the sanding frame including a base defining an opening, the sander supportable in the opening; and a leg selectively connectable to the base for supporting the base in an orientation where the abrasive surface is exposed for access by a user.

2. A sanding accessory for supporting a portable powered sander with a movable abrasive surface, the accessory comprising:

a sanding frame adaptable for supporting the sander during movement of the sander over a workpiece, the sanding frame including a base having a first surface and a second surface and the base lying substantially in a plane; and a leg selectively connectable to the base for supporting the base in an orientation wherein the plane of the base is one of substantially perpendicular to and planar parallel to the ground.

3. The sanding accessory of claim 2 further comprising a rod assembly pivotably connected to the base for movably supporting the sander.

4. The sanding accessory of claim 3 further comprising a depth-of-cut adjustment mechanism connected to the base and to the rod assembly for pivoting the rod assembly.

5. The sanding accessory of claim 4 wherein the rod is pivotable out of the plane of the base.

6. The sanding accessory of claim 5 further including a spring for biasing the rod towards the plane of the base.

7. The sanding accessory of claim 4 wherein the depth of cut mechanism includes:

a yoke connected to the base and defining a bore;

a treaded rod having a first end and a second end, and extending through the bore of the yoke;

a collar connected to the rod assembly and to the first end of the threaded rod; and a knob threadably engaged to the rod for drawing the rod through the yoke.

8. The sanding accessory of claim 7 wherein the depth of cut mechanism further includes a spring coaxial with the threaded rod between the collar and the yoke.

9. The sanding accessory of claim 3 wherein the pivotable rod assembly includes:

a recess defined by the base;

a bearing located in the recess and defining a bore;

a pivot pin having a first end and a second end, the first end rotateably supported in the bore;

a pivot arm having a first end and a second end, the first end connected to the second end of the pivot pin; and a rod connected to the second end of the pivot arm.

10. The sanding accessory of claim 2 further comprising a fence assembly connectable to the base.

11. The sanding accessory of claim 10 wherein the fence assembly includes a table angularly adjustable relative to the plane of the base.

12. The sanding accessory of claim 10 wherein the fence assembly includes a guard piece locatable adjacent to the abrasive surface.

13. A method for converting a sanding frame into a stand for a portable sander with a movable abrasive surface, the method comprising the steps of:

providing a sander frame adaptable for supporting the sander during movement of the sander over a workpiece and a leg;

mounting the sander to the frame attaching the leg to the sander frame so that the movable abrasive surface of the sander is exposed for access.

14. A sanding accessory for supporting a portable powered sander with a movable abrasive surface, the accessory comprising:

a sanding frame adaptable for supporting the sander during movement of the sander over a workpiece, the sanding frame including a base defining an opening, the sander supportable in the opening; and means for supporting the base in an orientation where the abrasive surface is exposed for access by a user.

15. A sanding frame for supporting a portable powered sander with a movable abrasive surface, the sanding frame comprising:

a base defining an opening, the sander being supportable in the opening, the sanding frame being operable in a first mode to orient the abrasive surface substantially parallel to the ground; and a leg separate from said base when said sanding frame is operable in said first mode, said sanding frame being operable in a second mode where said leg is coupled to said base to support the base in an orientation where the abrasive surface is exposed for access by a user.

16. The sanding frame of claim 15 wherein said abrasive surface is oriented substantially perpendicular to the ground when said sanding frame is operable in said second mode.

17. A sanding frame for supporting a portable powered sander with a movable abrasive surface, the frame comprising:

a base having a first substantially planar surface positioned in a first orientation substantially parallel to the ground; and a leg selectively connected to the base for supporting the base in a second orientation wherein the first surface of the base is positioned substantially perpendicular to the ground.

18. The sanding frame of claim 17 further comprising a rod assembly pivotably connected to the base for movably supporting the sander.

19. The sanding frame of claim 18 further comprising a depth-of-cut adjustment mechanism connected to the base and to the rod assembly for pivoting the rod assembly.

20. A sanding accessory for supporting a portable powered sander with a movable abrasive surface, the accessory comprising:

a sanding frame adaptable for supporting the sander during movement of the sander over a workpiece, the sanding frame including a base defining an opening, the sander supportable in the opening; and means for supporting the base in an orientation where the abrasive surface is positioned substantially perpendicular to the ground.

21. A sanding frame for supporting a portable powered sander with a movable abrasive surface, the sanding frame comprising:

a base defining an opening, the sander being supportable in the opening, the sanding frame being operable in a first mode to support the sander for movement across a work surface; and a leg separate from the base when said sanding frame is operable in said first mode, said leg being coupled to said sanding frame when said sanding frame is operable in a second mode to support the sander at a predetermined location where the abrasive surface is exposed for access by a user.

22. The sanding frame of claim 21 wherein the leg includes a portion adapted to contact the ground.

23. The sanding frame of claim 21 wherein the sanding frame is operable in said second mode to resist movement of the sander relative to the ground.

24. The sanding frame of claim 21 further comprising a rod assembly pivotably connected to the base for movably supporting the sander.

25. The sanding frame of claim 24 further comprising a depth-of-cut adjustment mechanism connected to the base and to the rod assembly for pivoting the rod assembly.

26. The sanding frame of claim 25 wherein the pivotable rod assembly includes:

a recess defined by the base;

a bearing located in the recess and defining a bore;

a pivot pin having a first end and a second end, the first end rotateably supported in the bore;

a pivot arm having a first end and a second end, the first end connected to the second end of the pivot pin; and a rod connected to the second end of the pivot arm.

27. The sanding frame of claim 25 wherein the rod is pivotable out of the plane of the base.

28. The sanding frame of claim 27 further including a spring for biasing the rod towards the plane of the base.

29. The sanding frame of claim 25 wherein the depth of cut mechanism includes:

a yoke connected to the base and defining a bore;

a treaded rod having a first end and a second end, and extending through the bore of the yoke;

a collar connected to the rod assembly and to the first end of the threaded rod; and a knob threadably engaged to the rod for drawing the rod through the yoke.

30. The sanding frame of claim 29 wherein the depth of cut mechanism further includes a spring coaxial with the threaded rod between the collar and the yoke.

31. The sanding frame of claim 21 further comprising a fence assembly connectable to the base.

32. The sanding frame of claim 31 wherein the fence assembly includes a table angularly adjustable relative to the plane of the base.

33. The sanding accessory of claim 31 wherein the fence assembly includes a guard piece locatable adjacent to the abrasive surface.

34. A method for converting a sanding frame into a stand for a portable sander with a movable abrasive surface, the method comprising:

providing a sander frame adaptable for supporting the sander during movement of the sander over a workpiece and a separate leg;

mounting the sander to the frame;

attaching the leg to the sander frame so that the movable abrasive surface of the sander is positioned substantially perpendicular to the ground.

35. The method of claim 34 further including disconnecting the leg from the frame and positioning the movable abrasive surface substantially parallel to the ground.

36. A method for converting a sanding frame into a stand for a portable sander with a movable abrasive surface, the method comprising:

providing a sander frame and a separate leg;

mounting the sander to the sander frame to define a first assembly;

operating the first assembly in a first mode by moving the first assembly relative to a work surface;

attaching the leg to the first assembly to define a second assembly;

operating the second assembly in a second mode by positioning the second assembly at a fixed location and moving a work piece relative to the second assembly.

37. The method of claim 36 further including adjusting the position of the movable abrasive surface relative to the sander frame.

38. The method of claim 36 further including coupling a frame to the sander frame.

* * * * *